United States Patent [19]

Gray

[11] Patent Number: 4,633,589

[45] Date of Patent: Jan. 6, 1987

[54] CAN OPENER

[75] Inventor: James W. Gray, Tucson, Ariz.

[73] Assignee: R. Rick Rodig, Denair, Calif. ; a part interest

[21] Appl. No.: 665,351

[22] Filed: Oct. 26, 1984

[51] Int. Cl.[4] ..... B67B 7/30

[52] U.S. Cl. ..... 30/427

[58] Field of Search ..... 30/416–427

[56] References Cited

U.S. PATENT DOCUMENTS

| | | | |
|---|---|---|---|
| 2,354,469 | 7/1944 | Lubetsky | 30/422 X |
| 2,573,030 | 10/1951 | LaForte | 30/422 |
| 2,583,034 | 1/1952 | Wibling | 30/424 X |
| 2,600,615 | 6/1952 | Carp | 30/426 |
| 2,850,799 | 9/1958 | Dodd et al. | 30/425 |
| 2,925,653 | 2/1960 | Stallard | 30/416 |
| 4,125,941 | 11/1978 | McKinley | 30/427 |

FOREIGN PATENT DOCUMENTS

| | | | |
|---|---|---|---|
| 608226 | 12/1978 | Switzerland | 30/416 |

*Primary Examiner*—James M. Meister

*Attorney, Agent, or Firm*—J. Michael McClanahan

[57] ABSTRACT

An improved can opener for removing the tops of cans of both straight sided tin can containers and containers having recessed tops such as commonly found in extruded aluminum cans used in the beverage industry. The improvement modifies the conventional hand held, two handle can opener commonly available of the type in which the handles pivotally separate to allow entrance of the can bead for engagement by lower traction wheel and an upper cutting wheel, the improvement being an extended rest protruding perpendicularly outward and against which the recessed top containers may be positioned and held in that position in order to be engaged by the traction wheel upon the lower end of the bead and the cutter wheel through the top. The extended rest holds the recessed top container at the proper angle with respect to the traction wheel and cutter wheel, in order to sever the top of a recessed top can, permitting the rotation of the container by the traction wheel under the cutter wheel until the top has been completely severed.

10 Claims, 6 Drawing Figures

CAN OPENER

BACKGROUND OF THE INVENTION

Can openers have reached a point in development where there have been relatively few improvements added over the basic elements of providing means to engage the underside of the built-up rolled over metal rim of the can container to pass the flat circular surface of the can lid or top through a cutter blade. In can container manufacture, the lid is a flat metal circular surface with a stepped rim at its periphery which forms an annular groove into which the can cylindrical sides are inserted. The stepped rim is then crimped to form the built-up rolled over metal rim. This built-up rolled over metal rim at the top of the can is commonly called the can bead or the bead. In most common tin plated sheet metal can containers, solder is added around the outside periphery of the bead to insure mechanical rigidity and air tightness.

As mentioned above, the usual and most common can openers employ a traction wheel which forcibly engages the underside of the bead while a rotatable cutter wheel is forced into the top of the can immediately interiorly to the top of the bead. With applied mechanical pressure, generally by holding two handles together, one handle havihg attached the traction wheel and the other handle having attached the cutter wheel, the can is rotated under the cutter wheel by rotation of the traction wheel until the can has rotated at least one time and the can top then severed completely around. At that point, the handles of the can opener are separated, disengaging the cutter wheel from the top of the can and permitting removal of the can and the severed top by lifting the can up off the traction wheel.

The above described can openers are similarily functionally described in patents which issued in the early 1950's, such as in the patents to Tuccori, Waller, Tuccori, and Hult, U.S. Pat. Nos. 2,551,183, 2,555,835, 2,632,946, and 2,715,265 respectively.

The above described can opener and referenced patents operate quite satisfactory on the tin plated steel can container which has been available to the public for many years. However, within the recent past, can containers with sides and bottom made from a single piece of extruded aluminum and a top affixed in the usual rolled over manner as was the practice with the tin plated sheet steel cans, except perhaps for soldering the top to the sides of the can, have become quite numerous in the market place. These can containers which the beverage industry is using very extensively usually have a push type or lever operated punch tab in the top for the user to remove the contents. However, there may be instances where the user wishes to remove the top of the can, either before or after the contents of the can have been removed, through the use of the punch tab type opening. This is especially so if the user contemplates a further use for the can not connected with the original beverage bottler, such as for storage of liquids, odd and ends, or perhaps as a reusable drinking container. All these uses are made practical if the tops are removed immediately adjacent to the inside of the can bead so that any sharp edges which might be left by the top removal operation and which might cut the person are not accessible to the person putting the can container to later use.

However, in the construction of the extruded aluminum can containers which are utilized by the beverage bottlers, the top is recessed inwardly a small amount, usually 1/16th. to ⅛th. inch from each side where the top of the can is joined to the sides of the can when the bead if formed. By this recession of the top of the can, the commonly available and conventional can openers do not remove the tops of the beverage cans. Depending upon the particular orientation of the traction wheel and the cutter wheel on the opener, or in some can openers that utilize a stationary cutter blade in place of the cutter wheel, the available can openers can not open the recessed top cans. In some can openers, because of the indentation or recession of the top, it is not possible to place the can bead between the traction wheel and the cutter wheel or cutter blade; and in other can openers, the bead tends to ride up and between the traction wheel and the cutter wheel or cutter blade so that the cutter wheel or cutter blade does not engage the top of the can to begin severing the top. However, it was discovered that if the extruded aluminum recessed top can container were held out an an angle greater than where the conventional can container resides, the can opener would operate, except that there was a tendency to fall away from the position and required that the container be held in that position, and in addition, that the cutter blade would cut through the top of the can and would also cut through the side of the can so that the resultant can container with the top removed presented a sharp edge which gave rise to the possibility of cutting a finger of the user. In these cases, the bead had been completely severed from both the top of the can and the sides also.

Thus it became apparent that if a person wished to remove the top of the new extruded aluminum beverage type can containers, it was necessary to either devise a new can opener or that improvements be added to existing can openers to perform the operation. Further, if the improved can opener were used to open the new type beverage can containers, in order for it to be practical in the market place, the ability of the original can opener to open the usual straight-sided can container should not be removed to add the improvement—that the improved can opener should still open both types of can containers.

Accordingly, it is to these ends that the subject invention is directed, i.e., to present an improvement to conventional can openers which adds to their function the ability of opening the can containers with recessed tops.

SUMMARY OF THE INVENTION

The present invention provides an improvement to conventionally available can openers whereby means are provided to enable the conventional can opener to additionally open the can or beverage type containers which have the recessed top. The improvement comprises means which permit the recessed top can container to be held out an an angle approximately 30° so that the conventional can opener traction wheel and cutter wheel may properly engage the can container while at the same time the can opener's cutter blade is inhibited from cutting both the top and the side of the can container, a fact that was not a problem when the opener was used on conventional straight sided cans since the cutter went substantially parallel to the sides of the can. In addition, the improvement, which takes the form of an extended rest attached to the conventional can opener, extends generally perpendicular to the plane of traction wheel, the extended rest providing an arcuate shaped stationary standard against which the side of the can rotates, and also holds the can in proper position in order that the cutter wheel will properly engage and sever the can top. The extended rest is pivotable from a position substantially parallel to the plane of the traction wheel where it is out of the way for opening conventional type cans to its position generally perpendicular to the plane of the traction wheel, and once located in the perpendicular position, is so held by a structural member which engages the body of the can opener and at the same time serves to inhibit the cutter wheel from cutting so deeply into the can top as to sever also the sides of the can. The inhibiting of the cutter wheel cutting into the sides of the can is accomplished by preventing with a stop the can opener body handle holding the cutter wheel from closing completely with the lower portion of the can opener which holds the traction wheel in order that the cutter wheel is held back from penetrating so deeply into the top of the can container that it will engage the side.

The operation of the improved can opener upon recessed top can containers to remove the top is accomplished similarily to that with the can containers with straight sides, namely the handles of the upper and lower body of the can opener are pivotally separated, the can bead placed between the traction wheel and the cutting wheel with the side of the can resting against the extended rest, the handles closed to force the traction wheel against the bottom of the bead and the cutting wheel into the top of the can to the limit permitted by the stop of the structural member restricting the depth of the cutter wheel. The traction wheel rotates to cause the can to rotate against the arcuate shape portion of the positioning extended rest, and as the can rotates, the cutter wheel penetrates and cuts the top. The can is removed by separating the handles. The can opener then returns to its conventional form by release of the structural holding member permitting the extended rest to rotate to a position sustantially parallel with the traction wheel and out of the way permitting utilizing the can opener with conventional straight sided can container. The end of the structural member engages a blind hole to fixedly hold the extended rest in the position out of the way.

It is an object of the subject invention to provide an improved can opener adapted to sever and remove the top of recessed top can containers.

It is another object of the subject invention to provide an improvement to conventional can openers which will enable the can opener to remove the top of recessed top can containers.

It is still further another object of the subject invention to provide a modification to a conventional can opener to remove the top of recessed top can containers where the conventional can opener may still be utilized to open straight sided can containers.

Other objects of the invention will in part be obvious and will in part appear hereinafter. The invention accordingly comprises the construction combining the elements and arranging the parts which are exemplified in the following detailed disclosure and the scope of the application of which will be indicated in the claims.

BRIEF DESCRIPTION OF THE DRAWINGS

For further understanding of the nature and objects of the present invention, reference should be had to the following description taken in connection with the accompanying drawings wherein.

In the various views, like index numbers refer to like elements.

DETAILED DESCRIPTION OF THE PREFERRED EMBODIMENT

Figure 1:
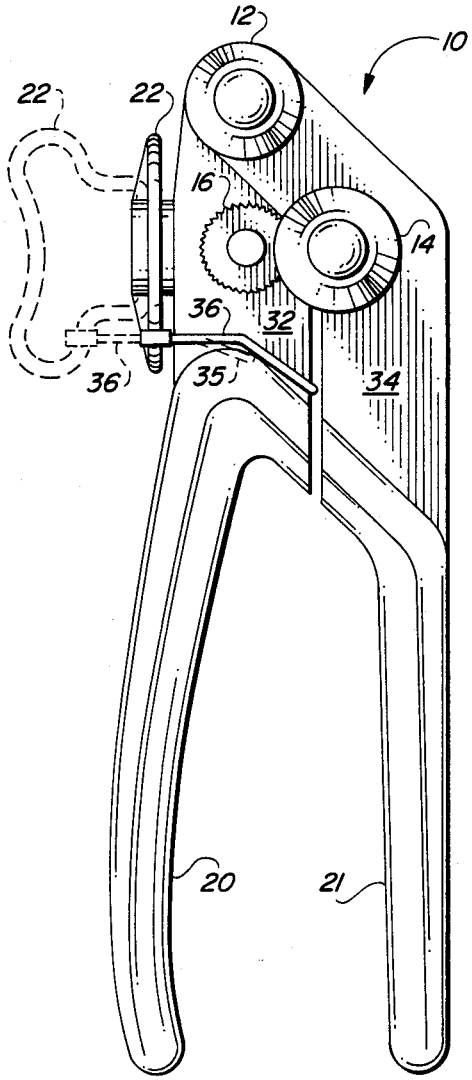
FIG. 1 is a front view of a conventional can opener with the improvement attached.
Figure 2:
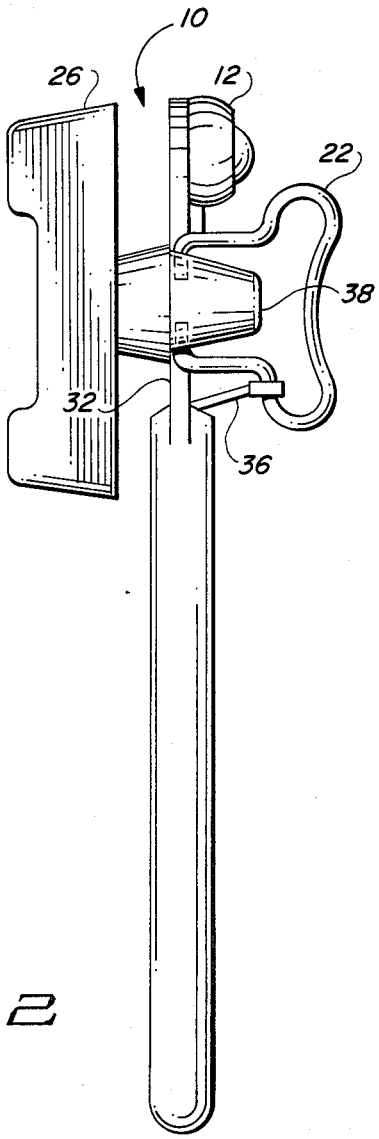
FIG. 2 is a side view of a conventional can opener with the improvement attached.
Figure 3:
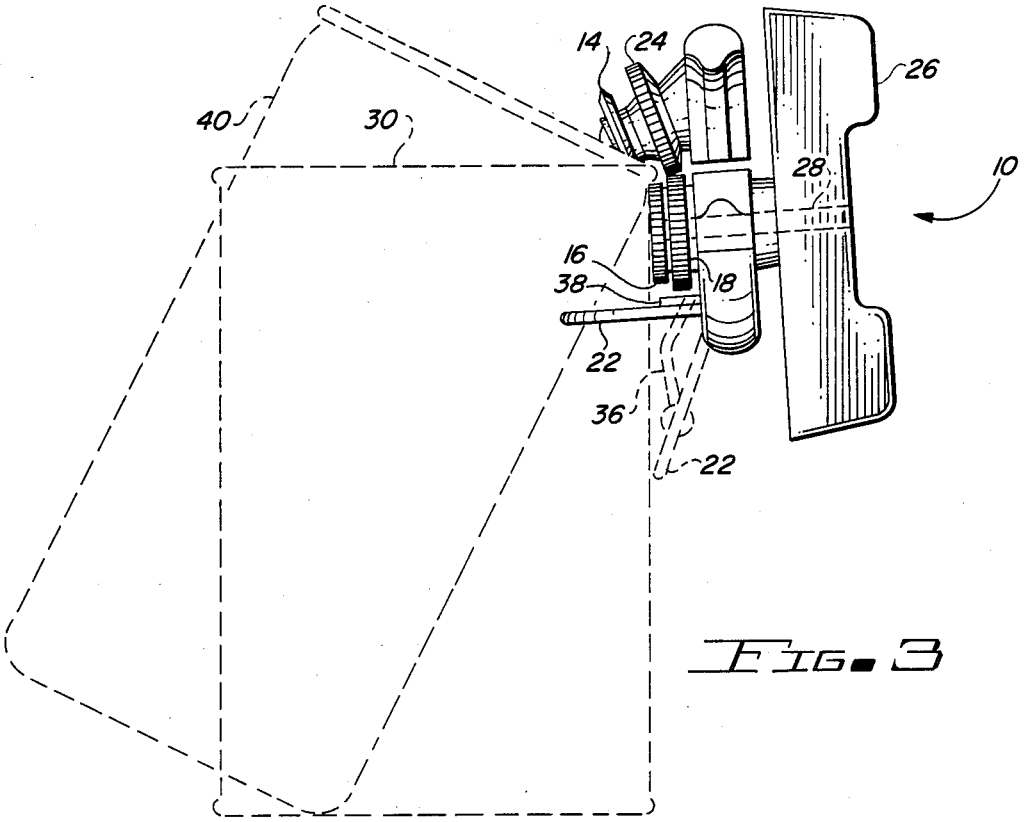
FIG. 3 is an end view of a conventional can opener with the improvement attached and also with the improvement being utilized.

Referring to FIGS. 1–3 in combination, a front view, side view, and an end view of an Ekco brand conventional can opener 10 with the added improvement is shown. The added improvement enables can opener 10 to open both the usual straight sided tin can container having the built up rolled over metal rim at the top of the parallel sides where the can top is bent over securing to the edge of the cylinder of the can, commonly called the can bead or bead, and the type of the can container where the top is recessed inwardly terminating in the built-up rolled over metal rim or bead. Detailing firstly the major elements comprising the conventional portion of can opener 10, shown are the two handles 20 and 21 which rotate about pivot point 12 to open and close, here shown in closed position.

The feature of can opener 10 to open conventional straight sided cans is accomplished by first pivoting apart the handles 20 and 21 which expose for engagement the cutter wheel 14 and the flat circular traction wheel 16. The can with the straight sides and protruding top bead is located substantially vertical in dotted form as shown in FIG. 3 where it can be seen that flat circular traction wheel 16 engages the lower outside edge of the bead and then the handle 21, having attached to its lower body portion cutter wheel 14, is brought down over the can top forcing cutter wheel 14 into the top and starting the circular cut. In the conventional portion of the can opener shown, driving gear 18 is attached to traction wheel 16 through a common axle and drives gear 24, gear 24 in turn attached to cutter wheel 14 also through a common axle attached at an angle of approximately 60° to the flat part of upper body portion 34. The turning handle 26 is rotated by hand, handle 26 attached at its center to axle 28 which in turn is the common axle attached to driving gear 18 and flat circular traction wheel 16, axle 28 at right angle to the flat part of lower body portion 32, and thus the plane of flat traction wheel 16 parallel to the flat part of lower body portion 32. Rotation of handle 26 rotates traction wheel 16 whose teeth are forced into the underside of the bead of conventional can 30 by the pressure of cutter wheel 14 engaging the top of the can. As handle 26 is rotated, traction wheel 16 is similarily rotated and in turn revolves conventional can 30 around and past the cutter wheel 14. When the operation is complete and the top of the can completely severed from the remainder of the can, the handles 20 and 21 are pivoted apart, disengaging the cutter wheel 14, and the conventional can 30 removed by lifting off the traction wheel 16.

The improvement to the conventional type Ekco can opener detailed in the FIGS. 1–3 is extended rest 22, illustrated in both its folded down non-use position in FIGS. 1 and 3 as dotted lines, and, in its outstanding used position in the figures as solid lines. Additionally, an inner flange on cutter wheel 14 is modified as later described.

Extended rest 22 is pivoted from the lower portion of the flat metal plate lower body portion 32 attached to handle 20, lower body portion 32 also serving as the means for attachment of toothed traction wheel 16 and pivot point 12 about which upper body portion 34 also pivots, upper body portion 34 being attached to handle 21 and securing the axle about which cutter wheel 14 and gear 24 rotate. To secure extended rest 22 in an outstanding position for use with the extruded aluminum cans with recessed tops, a support member 36 engages a part of extended rest 22 and hooks over a notch formed in the top edge of lower body portion 32. Support member 36 engages extended rest 22 with one end wrapped around the wire forming extended rest 22 so that there is pivotal movement at that point. In operation utilizing the extended rest to remove the recessed top from an extruded aluminum can, extended rest 22 is pivoted up to a position substantially perpendicular to the traction wheel 16 and driving wheel 18. The hook on the opposite end of support 36 is placed over a notch formed in the upper edge of lower body portion 32 to fix extended rest 22 in position. It is noted that the thickness of the support member 36 which extends above the edge of lower body portion forms a stop and prevents the two body portions, i.e., upper and lower body portions 34 and 32 respectively, from closing completely, but remaining slightly separated. It has been determined that such separation lifts the cutter wheel 14 up and prevents it from penetrating the top of the extruded aluminum can to a depth such that it would also cut through the side of the can, which it would do if the upper body portion 34 were allowed to come into complete contact with the lower body portion 32. It is noted that the stop formed by the support member 36 obviates the problem of cutting through the side of the can.

In operation, the invention combined can opener may be utilized for removing the tops from the straight sided tin cans by pivoting extended rest 22 downward to a position where it is somewhat parallel to the plane of the traction wheel 16 and driving gear 18, such as shown in the end view of FIG. 3 where conventional can 30 is shown by dotted lines in position. For ease of illustration, pivot point 12 has been omitted from the drawing of FIG. 3. It is noted that a blind hole, numeral 35 in FIG. 1, is drilled into the metal plate of lower body portion 32 to receive the hooked end of support member 36 and hold extended rest 22 in the down position (support member 36 end is shown entering the blind hole 35 in FIG. 1 (dotted line). Utilizing can opener 10 to open conventional cans allows the can to come against the present existing can rest 38 shown in FIG. 3 and better shown in side view of FIG. 2. The base of can rest 38 provides means into which blind holes are formed on either side (or one hole all through) for receiving of the ends of the wire form that comprises extended rest 22 and permitting the pivoting of extended rest 22 within those blind holes.

To utilize the inventive combined can opener to remove the top of extruded aluminum type beverage cans, the first step is to place the extended rest 22 in the position shown by the solid lines in FIGS. 1–3, namely substantially perpendicular to the plane of traction wheel 16 and driving gear 18. To accomplish such, support member 36 is first disengaged from the blind hole holding extended rest 22 parallel to traction wheel 16, the extended rest 22 grasped by the fingers and rotated to the perpendicular position, and support member 36 so manuevered to place the hook at its end into the notch formed in the upper edge of lower body portion 32. Obviously, upper body portion 34 must be pivoted away from lower body portion 32 sufficiently for the hook of support member 38 to engage the notch placed in lower body portion 32. To introduce the recessed top can 40 into can opener 10, the upper handle 21 must be rotated sufficiently away from the lower handle 20 to allow the bead of can 40 to pass under cutting wheel 14 in order that traction wheel 16 may engage the underside of the bead. This is accomplished when can 40 rests against extended rest 22 as shown in FIG. 3, can 40 being held out at an approximate 30° angle. At this point, the upper handle 21 is then brought back to a closed position, bringing down cutter wheel 14 into position to sever the top of can 40, also pressing can 40 bead into an engagement position with traction wheel 16. Then, the teeth of upper gear 24 connected with cutter wheel 14 begin to engage the teeth of driving gear 18 connected to traction wheel 16 in order that as driving gear 18 is rotated by turning handle 26 to which it is connected, upper gear 24 is also rotated as is cutter wheel 14. It is noted that the cutter wheel 14 was further modified by grinding down a circular extended flange that existed between the cutting wheel 14 and gear 24 which abutted gear 24 to space it from cutter wheel 14. In reducing the diameter of the flange 25, there still remained sufficient flange to abut and hold gear 24 in place. By reduction of this flange, sufficient room is now provided for the bead of the can when the can is tilted with respect to the cutter wheel 14.

It is noted that when the upper handle is brought into its position proximate lower handle 21, upper body portion 34 will press against the top edge of the hooked over portion of support member 36 acting as a stop and additionally hold extended rest 22 in a secured position. As the two handles are forcibly brought together, the cutter wheel 14 is forced through the top of the can to its initial starting position. Lastly, turning handle 26 is rotated with the fingers of one hand while fingers of the other hand holds the handles 20 and 21 in their closed position. Traction wheel 16, in rotating, revolves the recessed top extruded aluminum can 40 top under cutting wheel 14 until the can has made one revolution at which time the top of the can will be completely severed. The recessed top can 40 then may be removed from the combined can opener 10 by opening again the handles 20 and 21 to disengage the traction wheel 16 from the underside of the bead can 40 and to swing cutter wheel 14 up and out of the way.

It has been noted that the tops of some recessed top can containers are recessed more than others. In these cases, traction wheel 16 may engage the recessed portion of the side of the can directly underneath the bead of the can.

If desired, and if no other use for the can opener is immediately required, the hooked end of support member 36 may be removed from the notch cut in lower body portion 32, extended rest 22 rotated to a position somewhat parallel with traction wheel 16 and driving gear 18, the hook of support member 36 inserted into the blind hole 35 drilled in the metal plate of lower body portion 32, and the can opener then placed into storage until further use is required.

Figure 4:
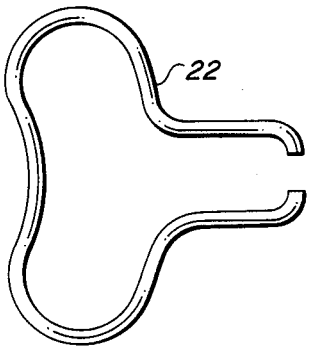
FIG. 4 is a top view of the extended rest which is added to the conventional can opener.

In detailing the added elements to the conventional can opener, FIG. 4 illustrates the extended rest 22 which has been removed from its position residing in the blind holes formed in the base of rest 38 of lower body portion 32. As seen in FIG. 4, the broken ends of extended rest 22 each fit into one of the above mentioned blind holes in lower body portion 32 which permit the rotation of extended rest 22 from a position generally parallel to traction wheel 16 to the position of use, generally perpendicular to traction wheel 16. Additionally, the portion of extended rest 22 which receives the recessed top can is arcuate shaped to conform with the side of the can.

Figure 5:
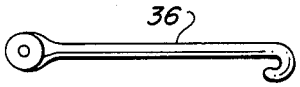
FIG. 5 is a side view of the structural member which secures the extended rest in place.

FIG. 5 is a side view of support member 36 which at one end surrounds a portion of extended rest 22 in a pivotal relationship, and at the other end terminates in a hook adapted to ride over the upper edge of lower body portion 32 and in the notch or groove formed thereon, or to reside in the blind hole formed in the metal plate of lower body portion 32.

Figure 6:
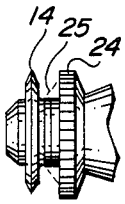
FIG. 6 is a broken-away view of the cutter wheel and gear assembly.

Referring now to FIG. 6, a break-away view of cutter wheel 14 and gear 24 is shown. Shown intermediate cutter wheel 14 and gear 24 is the extended circular flange 25 which has been ground down or turned partially off with a lathe in order that the recessed top can bead may be received between cutter wheel 14 and gear 24. While a small amount of the extended circular flange 25 formerly existing does still reside, it is still sufficient to restrain the gear 24. Staight sided conventional can containers are still opened satisfactorily, the top bead of the can held in place pressured against the traction wheel 16 by the cutter wheel 14 which, because of its sloped sides, presses the side of the can against the traction wheel. Additionally, the pressure of the cutter wheel 14 cutting through the can exerts downward pressure on the can bead to keep the bead fully engaged in the teeth of the traction wheel.

While a preferred embodiment of the invention has been shown and described, it will be appreciated that there is no intent to limit the invention by such disclosure. Accordingly, the disclosure is intended to cover all modifications and alternate embodiments falling within the spirit and the scope of the invention as defined in the appended claims.

I claim:

1. An improved can opener adapted to open recessed top type cylindrical can containers of the type having a bead at the top comprising:

an upper body portion, said upper body portion including an outstanding handle, a circular cutting wheel, and a first rotary gear, said circular cutting wheel and first rotary gear attached by a first common axle to said upper body portion;

a lower body portion pivotally attached to said upper body portion, said lower body portion including an outstanding handle, a flat circular traction wheel, a second rotary gear, and a turning handle; said turning handle, traction wheel, and second rotary gear attached by a second common axle to said lower body portion, said second rotary gear adapted to be engaged by said first rotary gear, said traction wheel adapted to engage the underside of an associated recessed top can bead;

said lower body portion also including an outstanding extended rest having an arcuate shaped portion, said arcuate shaped portion adapted to engage the side of an associated recessed top can container, said rest extending beyond said traction wheel sufficient to hold the container at an angle of approximately 30° to the flat circular traction wheel such that said traction wheel will engage the recessed can bead;

said lower body portion further including a groove formed therein; and an elongated structural member operably attached at a first end to said extended rest and operably attached at a second end to said lower body portion groove, said structural member securing said extended rest in an outward position whereby said upper body portion may be pivoted to a closed position with said lower body portion and thus bring the circular cutting wheel into the top of the can to force the traction wheel teeth into the underside of the bead of the can, and by turning the turning handle, the traction wheel is rotated which rotates the associated container can top into the cutter wheel and thus severs the top from the container can to open the can.

2. The improved can opener as defined in claim 1 wherein said structural member additonally provides a stop to said upper body portion when said upper body portion is pivoted to a closed position with said lower body portion in order that the depth of penetration of the cutter wheel into the associated can container may be limited.

3. The improved can opener as defined in claim 2 wherein said lower body portion includes a pair of blind holes, said pair of blind holes receiving and securing said extended rest.

4. A combined can opener adapted to open straight sided conventional can containers and recessed top can containers comprising:

an upper body portion, said upper body portion including an outstanding handle, a circular cutting wheel, and a first rotary gear, said circular cutting wheel and first rotary gear attached by a first common axle to said upper body portion;

a lower body portion pivotally attached to said upper body portion, said lower body portion including an outstanding handle, a flat circular traction wheel, a second rotary gear, and a turning handle; said turning handle, traction wheel, and second rotary gear attached by a second common axle to said lower body portion, said second rotary gear adapted to be engaged by said first rotary gear, said traction wheel adapted to engage the underside of an associated can container bead, said lower body portion also including a pivotable extended rest adapted to be pivoted to an outstanding position to engage the side of an associated recessed top can container to hold the container at an angle of approximately 30° to the flat circular traction wheel whereby said upper body portion may be pivoted to a closed position with said lower body portion and thus bring the circular cutting wheel into the top of the container to force the traction wheel into the bead of the can, and by turning the turning handle, the traction wheel is rotated which rotates the associated container can top into the cutter wheel and thus severs the top from the recessed top container can to open the can, and said outstanding extended rest may then be pivoted to a non-use position from its outstanding position to permit opening of straight sided conventional can containers by the combined can opener.

5. The improved can opener as defined in claim 4 further including an elongated structural member pivotally attached at a first end to said extended rest, said elongated structural member having a second end adapted to operably attach to said lower body portion, said structural member adapted to secure said extended rest in a pivotal outward position to be utilized when cutting tops from associated recessed top can containers.

6. The improved can opener as defined in claim 5 wherein said lower body portion includes a groove formed therein, said groove adapted to receiYe said second end of said structural member to secure said extended rest in its outstanding position.

7. The improved can opener as defined in claim 6 wherein said structural member additionally defines a stop to said upper body portion when said upper body portion is pivoted to a closed position with said lower body portion in order that the depth of penetration of the cutter wheel into the associated can container may be limited.

8. The improved can opener as defined in claim 7 wherein said lower body portion includes a blind hole, said blind hole adapted to receive said structural member second end when said extended rest is pivoted out of its outstanding position to a non-use position when the can opener is to be used to open conventional straight sided can containers.

9. The improved can opener as defined in claim 8 wherein said lower body portion includes a pair of blind holes, said pair of blind holes adapted to receive said extended rest enabling said extended rest to pivot.

10. The improved can opener as defined in claim 9 wherein said extended rest includes an arcuate shaped portion, said arcuate shaped portion adapted to be engaged by the associated recessed top can container's sides.

* * * * *